US006068387A

United States Patent [19]

Hilton

[11] Patent Number: 6,068,387

[45] Date of Patent: May 30, 2000

[54] LIGHT FIXTURE WITH TRIM MOUNTING CLIP

[75] Inventor: Ernie P. Hilton, Americus, Ga.

[73] Assignee: Cooper Technologies Company, Houston, Tex.

[21] Appl. No.: 09/233,074

[22] Filed: Jan. 19, 1999

[51] Int. Cl.[7] ..... F21K 27/00

[52] U.S. Cl. ..... 362/260; 362/147; 362/396

[58] Field of Search ..... 362/147, 148, 362/225, 260, 374, 375, 396

[56] References Cited

U.S. PATENT DOCUMENTS

| | | | |
|---|---|---|---|
| 3,697,743 | 10/1972 | Eargle | 362/260 |
| 3,748,469 | 7/1973 | Price | 362/347 |
| 4,344,111 | 8/1982 | Ruud | 362/33 |
| 4,580,200 | 4/1986 | Hess et al. | 362/223 |
| 4,698,733 | 10/1987 | Griffin | 362/222 |
| 4,729,075 | 3/1988 | Brass | 362/217 |
| 4,745,533 | 5/1988 | Smerz | 362/364 |
| 5,072,344 | 12/1991 | Fabbri | 362/150 |
| 5,088,670 | 2/1992 | Taylor | 248/224.61 |
| 5,126,510 | 6/1992 | Bauer et al. | 174/52.1 |
| 5,349,510 | 9/1994 | Jordan et al. | 362/374 |
| 5,410,459 | 4/1995 | Yang | 362/249 |
| 5,609,414 | 3/1997 | Caluori | 362/366 |
| 5,707,143 | 1/1998 | Hentz | 362/365 |
| 5,738,436 | 4/1998 | Cummings et al. | 362/294 |
| 5,791,764 | 8/1998 | Jaksich | 362/222 |

*Primary Examiner*—Sandra O'Shea
*Assistant Examiner*—Hargobind S. Sawhney
*Attorney, Agent, or Firm*—Fish&Richardson, PC

[57] ABSTRACT

A light fixture with a trim mounting clip is provided. The clip is secured to the light fixture and a trim mounts to the light fixture using the mounting clip. The trim and the mounting clip are configured such that the clip is not visible when the trim is attached to the light fixture.

19 Claims, 7 Drawing Sheets

LIGHT FIXTURE WITH TRIM MOUNTING CLIP

TECHNICAL FIELD

This invention relates to a light assembly that includes a light fixture to which a separate trim is connected.

BACKGROUND

Light fixtures are used for mounting lights onto ceilings. Fluorescent light fixtures are a popular choice in lighting since they provide a high luminosity with a high efficiency. In the case of fluorescent lighting, a decorative trim is often mounted to the light fixture. The decorative trim serves to hide the unattractive fluorescent light fixture and to soften the fluorescent light which tends to be bright.

A trim can make it difficult and time consuming to change a light bulb in the fixture. For example, a user may be required to loosen the trim with a screwdriver. Also, if clips are attached to the light fixture, the user may find it difficult to release the trim from the fixture without a fair amount of effort and potential damage to the trim.

SUMMARY

The invention provides simple, tool-free mounting and removal of a trim from a light fixture mounted on a surface. To this end, a mounting clip is secured to the light fixture and the trim is attached and detached using the mounting clip. The trim and the mounting clip are configured such that the clip is not visible when the trim is attached to the light fixture.

In one general aspect, a light assembly includes a light fixture configured to be mounted onto a surface, a mounting clip secured to the light fixture, and a trim attached to the light fixture by the mounting clip. The trim may be attached and detached from the light fixture without use of tools.

The mounting clip includes a first section which attaches to the light fixture and a second section which extends from a lower end of the first section. The first section includes a first leg which extends from a side of the first section. The second section includes a second leg which extends from a side of the second section. The second leg interacts with the first leg to limit movement of the second section.

Embodiments may include one or more of the following features.

The mounting clip may be attached to a metal body of the light fixture.

Furthermore, the first leg may include a lip which extends at a right angle from the first leg. Additionally, the second leg may include a second lip which extends at a right angle from the second leg and interlocks with the first lip to limit movement of the second section during detachment of the trim from the light fixture.

To reduce friction between the trim and the mounting clip during attachment and detachment, a rounded end extends from a top of the second section. The rounded end also prevents the clip from digging into an interior of the trim.

The mounting clip may include an offset which extends from the first section. The offset controls spacing between the light fixture and the surface.

Other features and advantages will be apparent from the following description, including the drawings, and from the claims.

DETAILED DESCRIPTION

Figure 1:
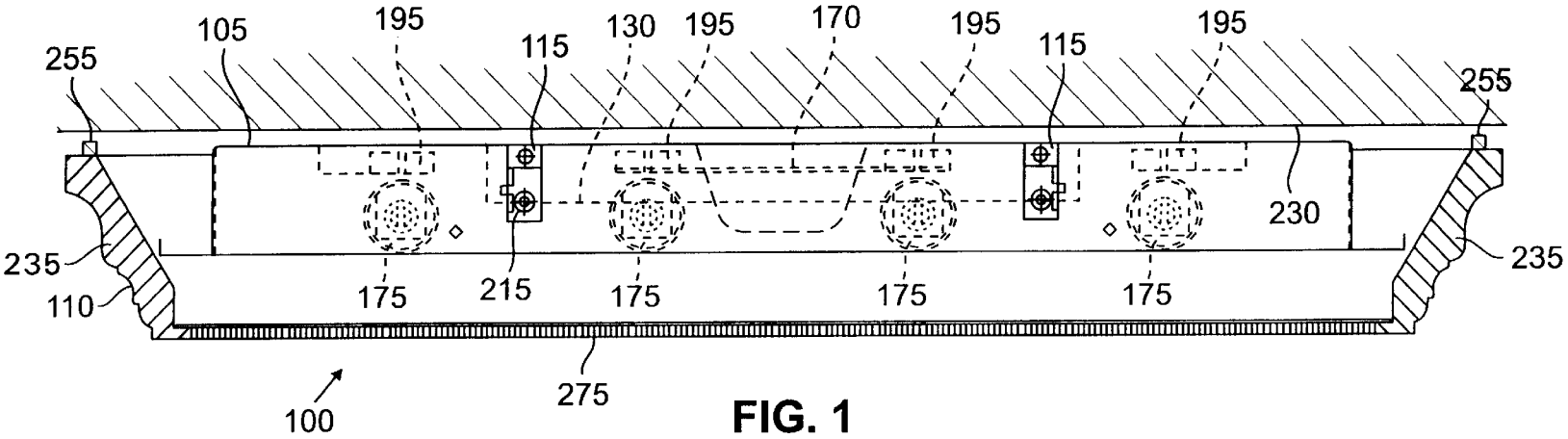
FIG. 1 is a cross-sectional end view of a light assembly having a light fixture with a set of mounting clips on which trim is mounted.
Figure 2:
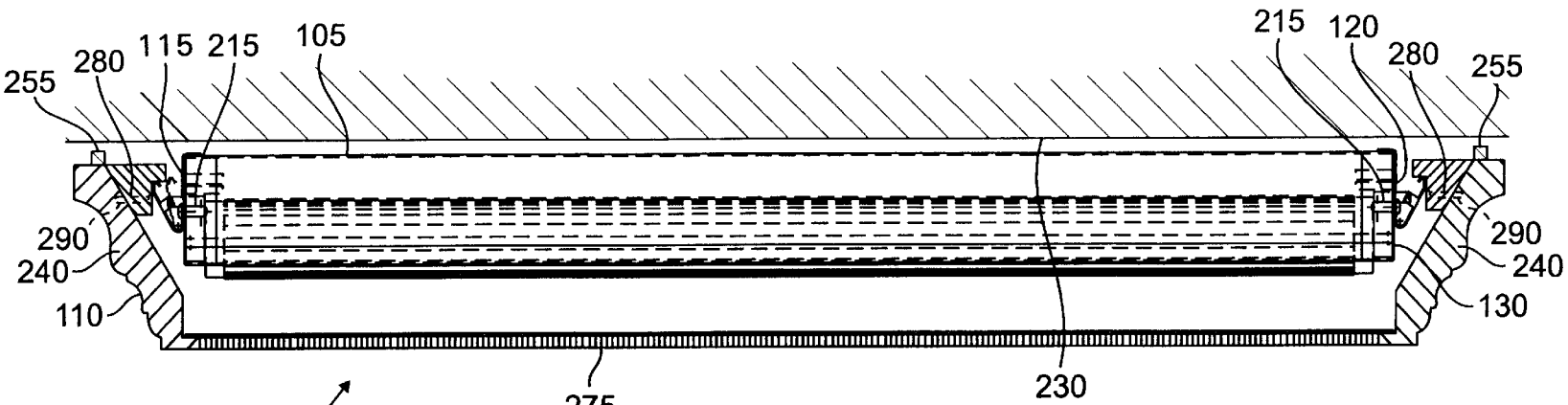
FIG. 2 is a cross-sectional side view of the light assembly of FIG. 1.

Referring to FIGS. 1 and 2, a light assembly 100 includes a light fixture 105 and trim 110 secured to the fixture by mounting clips 115, 120. A pair of mounting clips 115 are secured to a first end of a metal body 130 of the light fixture 105, and a pair of mounting clips 120 are secured to an opposite end. The four mounting clips are identical, and are described using different reference numerals for the sole purpose of simplifying discussion of their operation. The mounting clips 115, 120 serve to retain the trim 110 on the light fixture 105. In addition, the mounting clips 115, 120 facilitate attachment and detachment of the trim 110.

Figure 3:
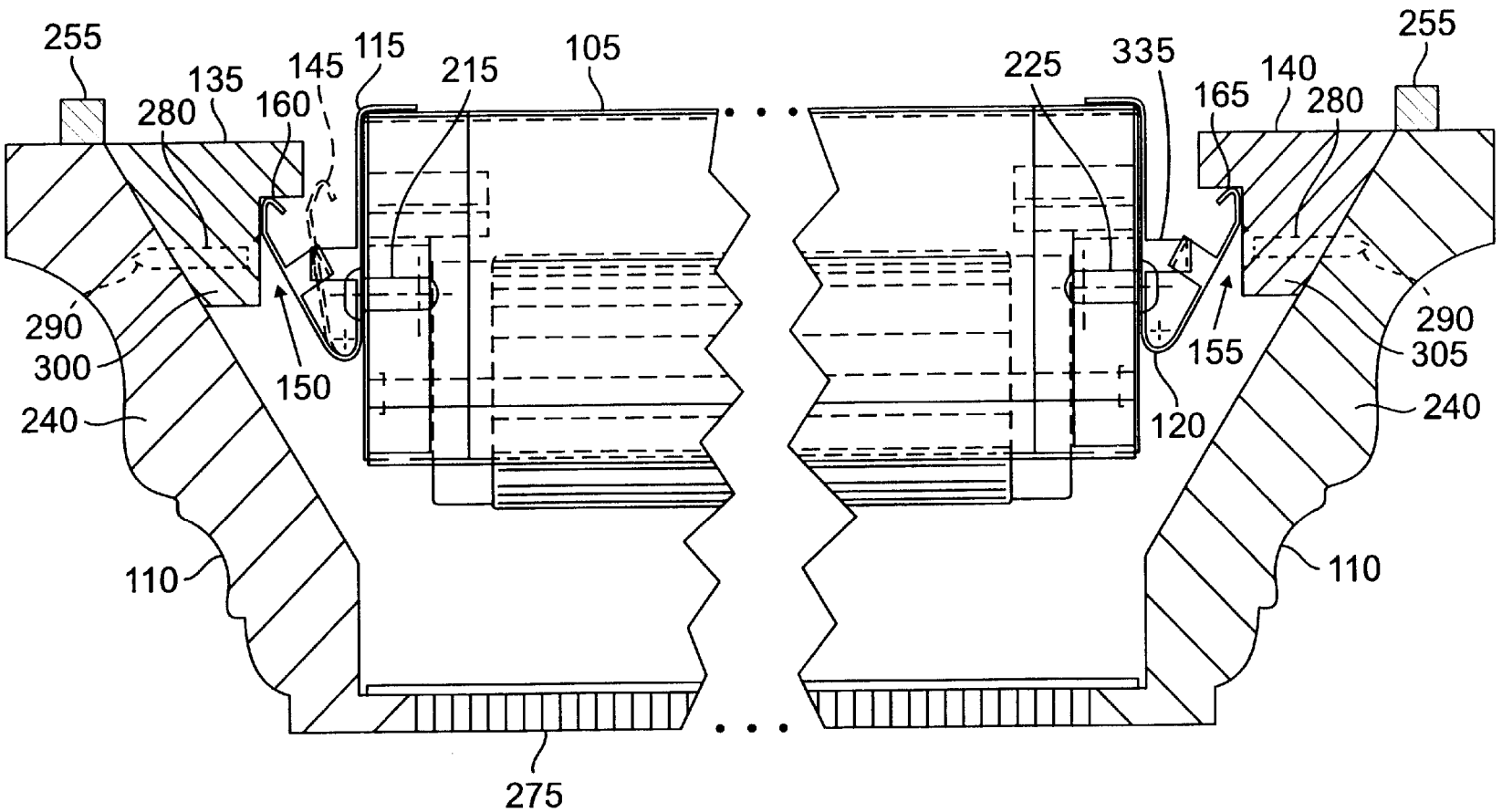
FIG. 3 is an enlarged view of ends of the light assembly of FIG. 2.

Referring also to FIG. 3, the trim 110 is attached to the light fixture 105 by aligning the trim 110 with the light fixture 105 and pushing the trim 110 up on to the light fixture 105. As the trim 110 moves towards the light fixture 105, retention portions 135, 140 on the trim 110 compress the mounting clips 115, 120 to an intermediate position (shown by dashed lines 145). Once the retention portions 135, 140 move beyond the mounting clips, the clips snap into place in channels 150, 155 to support the trim 110. In particular, the trim 110 is supported by bottom surfaces 160, 165 of the retention portions 135, 140 resting on top of the mounting clips 115, 120.

Figure 4:
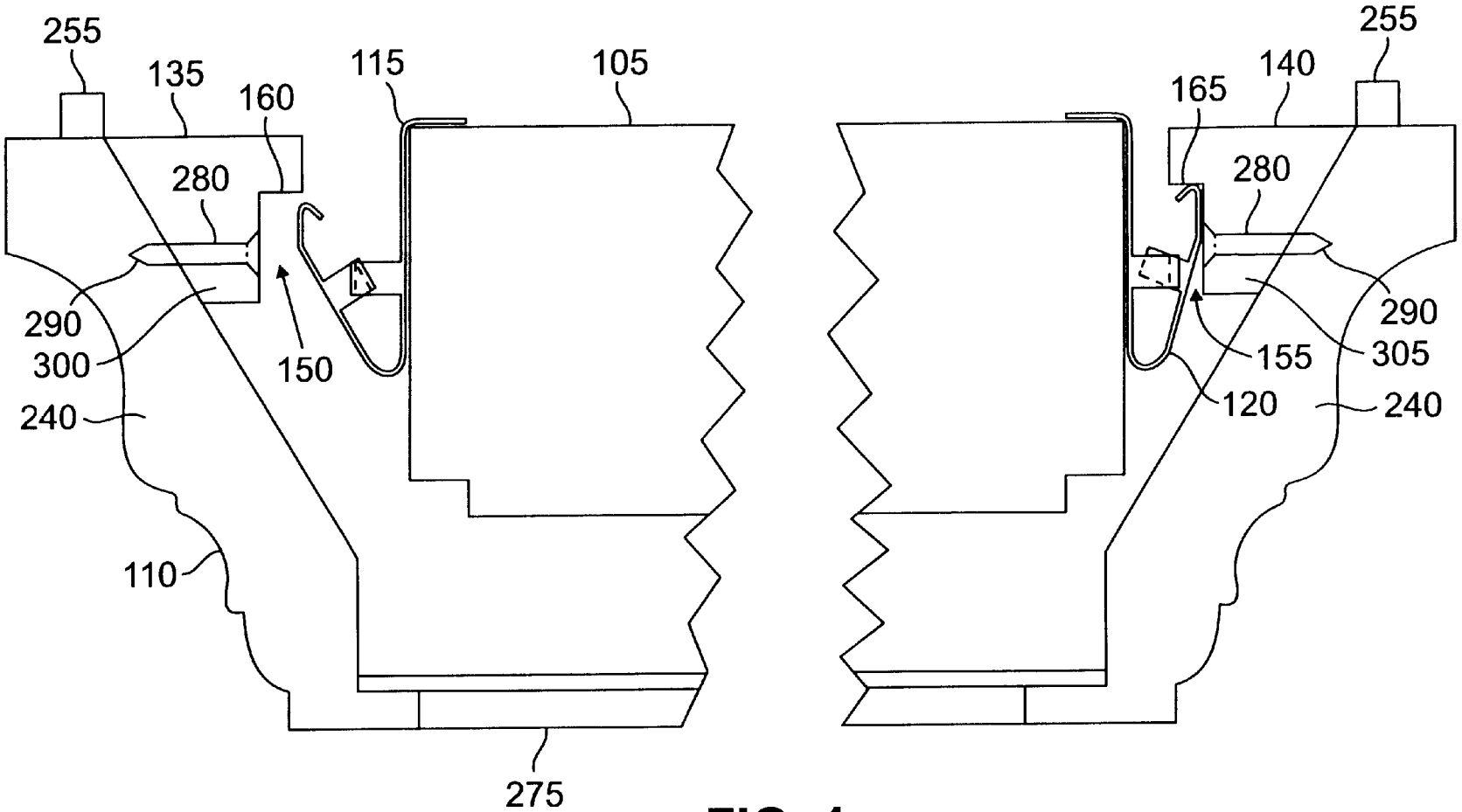
FIG. 4 is a view similar to FIG. 3 showing removal of the trim from the light fixture.
Figure 5:
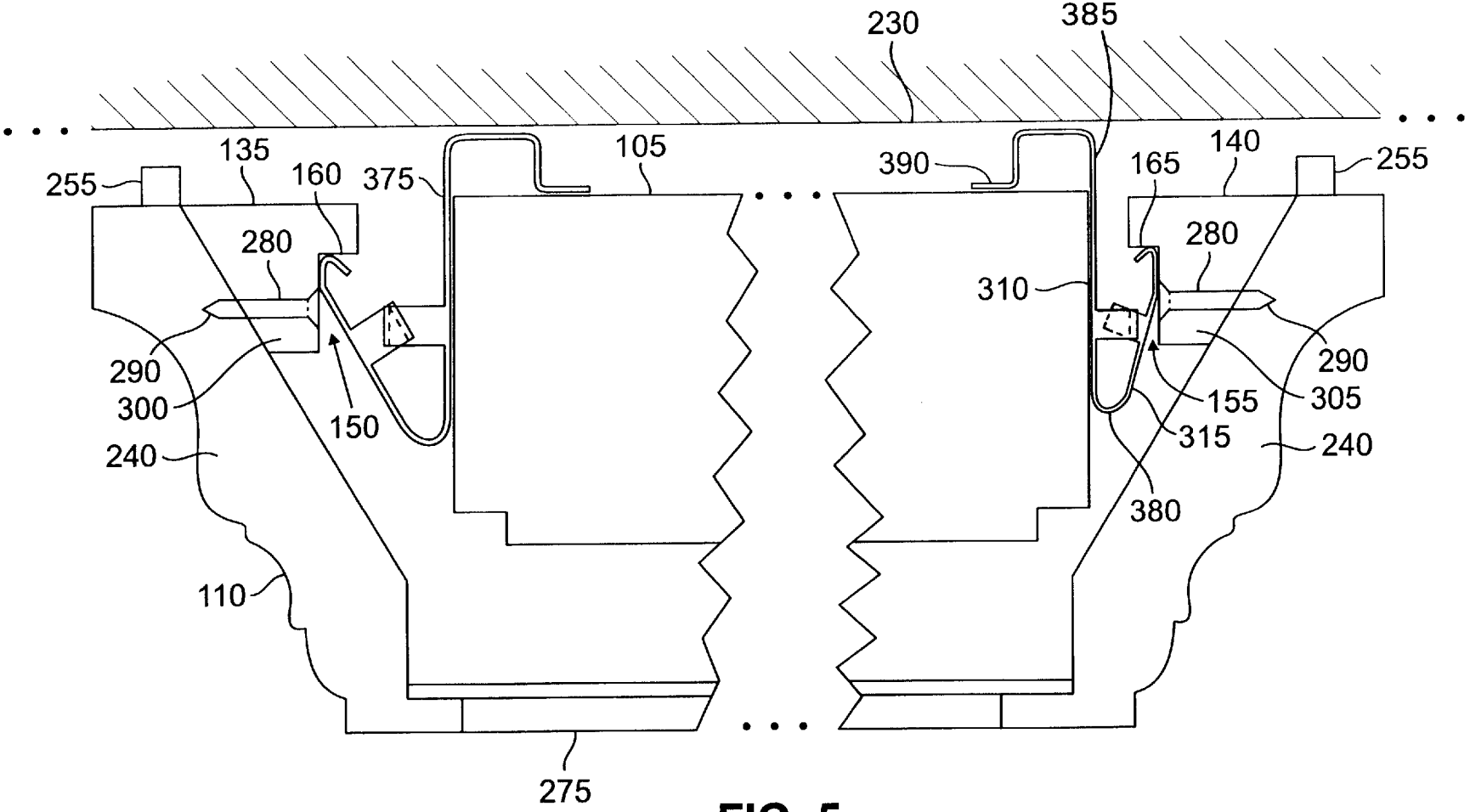
FIG. 5 is a view similar to FIG. 3 showing another version of the mounting clips.

Referring to FIG. 4, the trim 110 is detached from the light fixture 105 by pushing the trim to one side to release the trim 110 from one set of mounting clips. FIG. 4 shows the trim 110 pushed to the left so that the mounting clips 120 are compressed and the mounting clips 115 are no longer in the channel 150. Once the trim 110 is released by the mounting clips 115, the trim 110 may be removed from the light fixture 105 by lowering the left side of the trim 110 beyond the light fixture 105 and moving the trim 110 to the right to release it from the mounting clips 120. Of course, trim removal also may be initiated by pushing the trim 110 to the right.

Referring again to FIG. 1, the light fixture 105 includes a chamber 170 that holds wires and the lamp ballast (in the case of fluorescent lamps) or other electrical components. Additionally, light bulbs 175 are secured in the light fixture 105 by contacts 195. Each clip 115 is secured to the metal body 130 of the light fixture 105 by a pair of screws 215. The light fixture 105 is mounted to a surface 230, such as a ceiling, using screws extending through the metal body 130, or other appropriate means.

Referring to FIGS. 1–5, the trim 110 includes a frame formed from molding portions 235, 240. The retention portions 135, 140 are secured to an interior surface of the frame. Feet 255 extend from the top of the frame. The feet are of a length appropriate to space the trim from the ceiling by a desired amount. A light transmitter 275, such as a plastic lens, is positioned in an opening in the frame.

Retention portions 135, 140 may be made of wood and attached to an inner surface of the molding portions 235, 240. Molding portions 235, 240 are a decorative part of the trim 110 and are designed for visual appeal. Molding portions 235, 240 may be made of wood and may include a decorative shape and additional decorative features such as an applied surface paint or varnish. Each molding portion 235 may be attached at right angles to the next portion 240 to form the frame. The light transmitter 275 is configured to attach to an inside lower rectangular rim of the frame which is assembled from molding sections 235, 240.

The light transmitter 275 which is an optional component, may be made of a material that transmits light, such as glass or plastic, and may include openings to transmit light. Furthermore, the light transmitter 275 may be configured to alter the light characteristics of the light emanating from the bulbs 175. For example, light may be focused to a line or spot, or light may be diffused to create a soft glow.

Countersunk holes 280 in the retention portions 135, 140 align with blind holes 290 in the molding portions 245, 250. The retention portions 135, 140 are attached to the molding portions 245, 250 using screws inserted in the holes 280, 290. This arrangement serves to hide the screws and to prevent them from hindering attachment or detachment of the trim. The retention portions 135, 140 include side portions 300, 305 in which the blind holes 290 are positioned.

Figure 6:
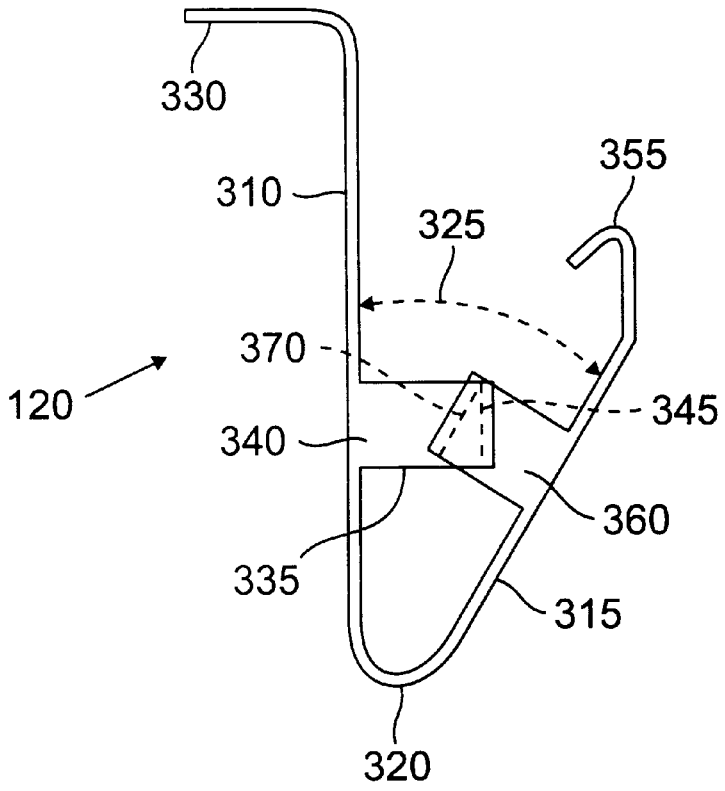
FIGS. 6–8 are side, top, and front views of the mounting clip of FIG. 1.
Figure 7:
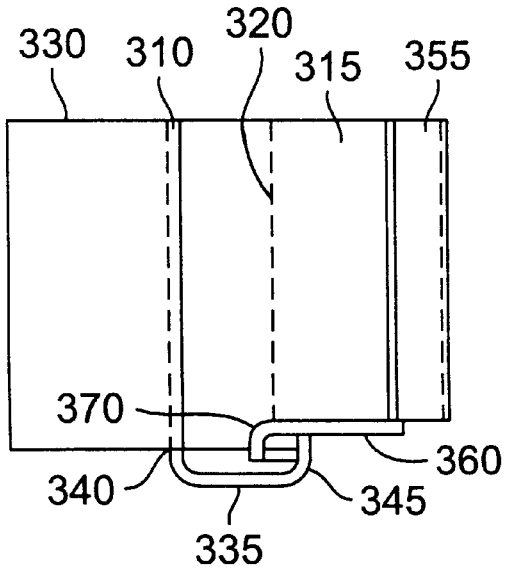
Figure 8:
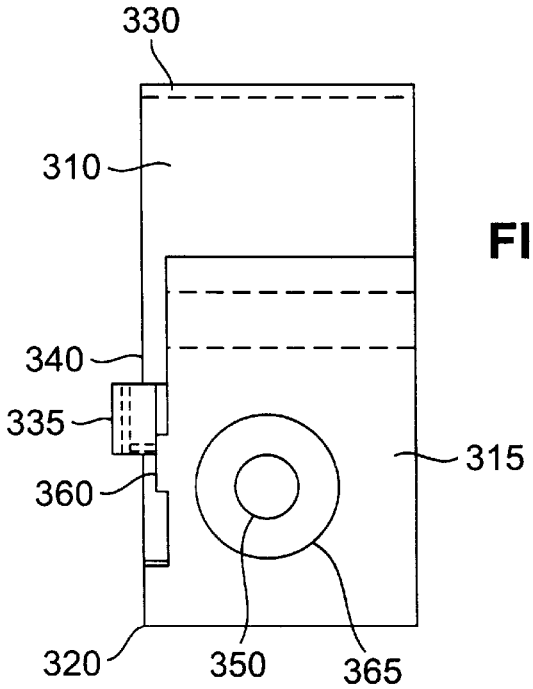
Figure 9:
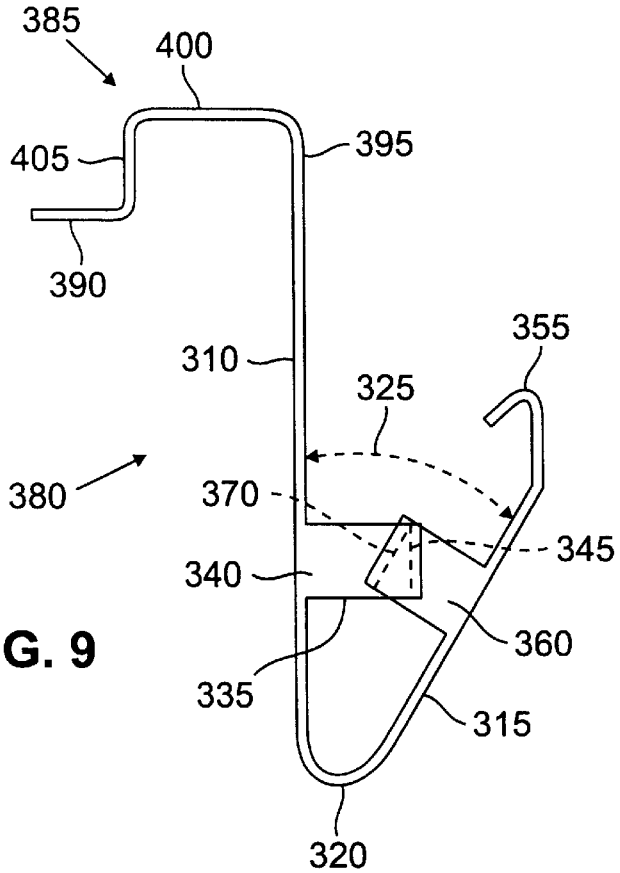
FIGS. 9–11 are side, top, and front views of the mounting clip of FIG. 5.
Figure 10:
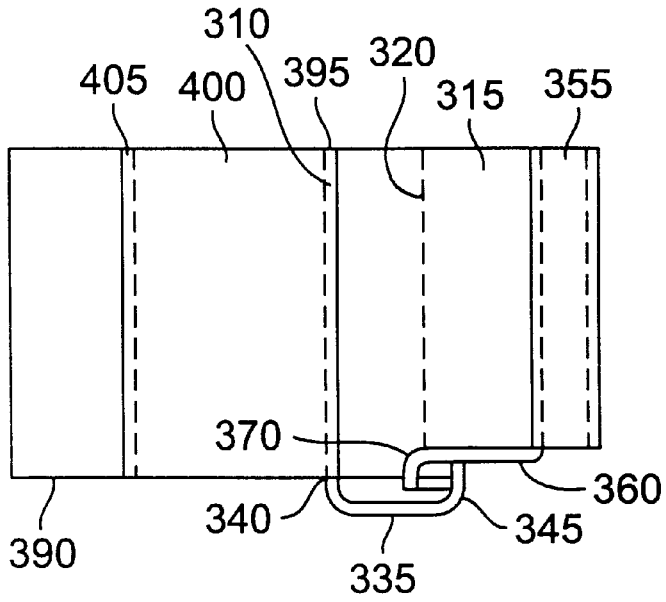
Figure 11:
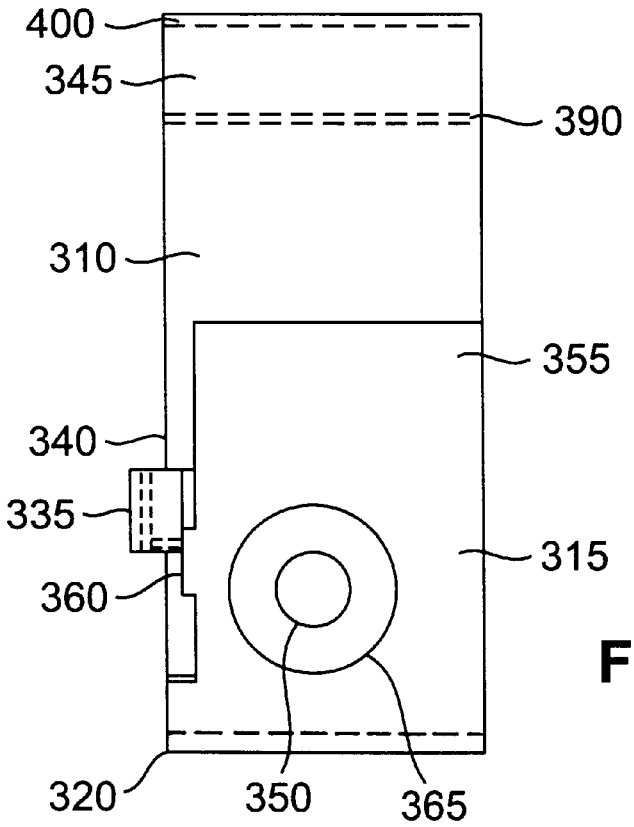

Referring to FIGS. 6–8, a mounting clip 120 (or a mounting clip 115) includes a first section (straight section) 315 that attaches to the metal body 130 of the light fixture 105. The clip also includes a second section (biased section ) 315 that extends upwardly from a lower end 320 of the straight section 310 at an acute angle 325 with the straight section 310.

A flat section 330 extends at a right angle from the top of the straight section 310. This section 330 rests against the top of the metal body 130 to provide additional support for the clip. Also, an outer leg 335 extends at a right angle from a side 340 of the straight section 310. The outer leg 335 includes a lip 345 that runs parallel with the straight section 310. A hole 350 may be drilled into the straight section 310 to ease insertion of the mounting screw 215 that attaches the clip 120 to the body 130 of the light fixture 105.

The biased section 315 includes a rounded end 355 and an inner leg 360. A second hole 365 is formed in the biased section 315 in alignment with the hole 350 in the straight section 310. The second hole 365 provides access for the mounting screw 215 that attaches the clip 120 to the body 130 of the light fixture 105.

The rounded end 355 of the biased section 315 prevents the clip 120 from digging into the retention portion 140, which, as noted above, may be made of wood. Additionally, the rounded end 355 serves to reduce friction between the biased section 315 and the retention portion 140, thus easing attachment and detachment of the trim 110.

The inner leg 360 includes a second lip 370 that runs parallel with the biased section 315. The second lip 370 interlocks with the lip 345 to limit rotation of the biased section 315 about the lower end 320. Thus, the acute angle 325 remains less than some maximum value defined by the interaction of the second lip 370 with the lip 345. This feature is particularly important during detachment of the trim 110 from the light fixture 105. During detachment, one clip 120 compresses while the other clip 115 is freed from the channel 150. The limited travel of the biased section 315 ensures that the clip 115 will slide out of the channel 150.

During attachment of the trim 110 to the light fixture 105, the retention portions 135, 140 push on the clips 115, 120 such that the biased section 315 pivots about the lower end 320 towards the straight section 310. See FIG. 3. After the retention portion 135, 140 clears the clip 115, 120 the biased section 315 snaps into the channel 150, 155. The trim 110 is held in place because the weight of the trim 110 rests on the rounded ends 355 of the clips 115, 120.

During detachment of the trim 110, the trim 110 is pushed to the left such that the biased section 315 of the clip 120 pivots about the lower end 320 towards the straight section 310. See FIG. 4. The biased section 315 of the clip 115 clears the channel 150. Once the trim 110 is released by clip 115, the trim 110 may be removed from the clip 120.

Referring to FIGS. 5 and 9–11, a second mounting clip 375 differs from the clips 115, 120 in that it includes an offset 385 that extends from the straight section 310 and a second flat section 390 that rests against the top of the metal body 130 to provide additional support for the clip. The offset 385 includes an extension 395 of the straight section 310, a flat section 400, and a second extension 405. The flat section 400 lies flush with the surface 230 to which the assembly 100 is attached and extends at a right angle to the extension 395. The second extension 405 connects at a right angle to the flat sections 390 and 400. The offset 385 serves to space the light fixture 105 from the ceiling surface 230 by an amount needed for the trim 110 to fit.

Other embodiments are within the scope of the following claims. For example, the light assembly 100 may be mounted to a vertical surface 230 such as a wall. Such an assembly 100 could be used in bathroom designs in which the light assembly 100 is mounted above a sink. In this embodiment, the trim 110 is supported by an interaction between the normal force of a single set of clips 115 and the weight of the trim 110 distributed at a side 300 of the retention portion 135.

What is claimed is:

1. A light assembly including:

a light fixture configured to be mounted onto a surface;

a mounting clip secured to the fixture, the clip comprising:

a first section (biased section) attached to the light fixture, the first section including a first leg extending from the first section; and a second section (biased section) extending from a lower end of the first section, the second section including a second leg interacting with the first leg to limit travel of the second section; and a trim attached to the light fixture by the mounting clip;

wherein the trim may be attached and detached from the light fixture without use of tools.

2. The light assembly of claim 1, wherein the clip and trim are configured such that the clip is not visible when the trim is attached to the light fixture.

3. The light assembly of claim 1, wherein the light fixture includes a metal body.

4. The light assembly of claim 3, wherein the mounting clip is attached to the metal body of the light fixture.

5. The light assembly of claim 1, wherein the first section includes a flat section extending at a right angle from a top of the first section, the flat section resting against the top of the light fixture.

6. The light assembly of claim 1, wherein the second section includes a rounded end, the rounded end reducing friction between the trim and the mounting clip during attachment and detachment.

7. The light assembly of claim 1, wherein the trim includes a frame formed from molding portions.

8. The light assembly of claim 7, wherein the trim includes retention portions secured to an interior surface of the frame.

9. The light assembly of claim 8, wherein a retention portion defines a channel in which the second section moves and rest.

10. The light assembly of claim 8, wherein the second section includes a rounded end that prevents the clip from digging into the retention portion during attachment and detachment.

11. The light assembly of claim 1, wherein the trim includes feet extending from the top of the trim to space the trim from the surface.

12. The light assembly of claim 1, wherein the first leg includes a lip extending at a right angle from an end of the first leg.

13. The light assembly of claim 12, wherein the second leg includes a second lip extending at a right angle from an end of the second leg, the second lip interlocking with the first lip to limit movement of the second section during detachment of the trim from the light fixture.

14. The light assembly of claim 1, wherein the mounting clip includes an offset extending from the first section, the offset controlling spacing between the light fixture and the surface.

15. The light assembly of claim 1, wherein the light fixture includes a first pair of mounting clips on a first end of the light fixture and a second pair of mounting clips on a second end of the light fixture, the first end being positioned opposite the first end.

16. A method for attaching and detaching a trim to a light fixture, the method comprising:

providing a mounting clip, the mounting clip including:

a first section attached to the light fixture, the first section including a first leg; and a second section extending from a lower end of the first section, the second section including a second leg interacting with the first leg to limit travel of the second section;

attaching the trim to the light fixture by pushing the trim past the mounting clip so that a portion of the trim pushes the second section toward the first section until the position of the trim moves past the second section, at which point the second section moves away from the first section to support the portion of the trim; and detaching the trim from the light fixture by moving the trim laterally away from the mounting clip until the second section no longer supports the trim;

wherein the attaching and detaching are accomplished without the use of tools.

17. The method of claim 16, wherein the clips and trim are configured to hide the clips when the trim is attached to the light fixture.

18. The method of claim 16, wherein the first section includes a flat section extending at a right angle from a top of the first section, the flat section resting against a top of the light fixture.

19. A mounting clip including:

a first section that attaches to a light fixture, the first section comprising:

a first leg extending from the first section and including a first lip extending at a right angle from an end of the first leg; and a flat section extending at a right angle from a top of the first section;

a second section extending up from a lower end of the first section, the second section comprising:

a second leg including a second lip extending at a right angle from an end of the second leg, the second lip interlocking with the first lip to limit travel of the second section relative to the first section; and a rounded end.

* * * * *

UNITED STATES PATENT AND TRADEMARK OFFICE

CERTIFICATE OF CORRECTION

PATENT NO : 6,068,387

DATED : May 30, 2000

INVENTOR(S) : Ernie P. HILTON

It is certified that error appears in the above-identified patent and that said Letters Patent are hereby corrected as shown below:

Col. 3, line 28, change "315" to --310--.

Col. 4, line 39, change "biased" to --straight--.

Signed and Sealed this

Tenth Day of April, 2001

*Attest:*

Nicholas P. Godici

NICHOLAS P. GODICI

*Attesting Officer*

*Acting Director of the United States Patent and Trademark Office*